US011473334B2

(12) United States Patent
Huang et al.

(10) Patent No.: US 11,473,334 B2
(45) Date of Patent: Oct. 18, 2022

(54) ROTATING CYLINDER AND LOCK

(71) Applicant: TAIWAN FU HSING INDUSTRIAL CO., LTD., Kaohsiung (TW)

(72) Inventors: Lien-Hsi Huang, Kaohsiung (TW); Yu-Cheng Lin, Tainan (TW)

(73) Assignee: TAIWAN FU HSING INDUSTRIAL CO., LTD., Kaohsiung (TW)

( * ) Notice: Subject to any disclaimer, the term of this patent is extended or adjusted under 35 U.S.C. 154(b) by 335 days.

(21) Appl. No.: 16/940,409

(22) Filed: Jul. 28, 2020

(65) Prior Publication Data

US 2021/0317682 A1 Oct. 14, 2021

(30) Foreign Application Priority Data

Apr. 10, 2020 (TW) ..... 109112158

(51) Int. Cl.
*E05B 3/00* (2006.01)
*E05B 15/00* (2006.01)
(Continued)

(52) U.S. Cl.
CPC ..... *E05B 3/003* (2013.01); *E05B 13/004* (2013.01); *E05B 13/108* (2013.01);
(Continued)

(58) Field of Classification Search
CPC ... E05B 3/003; E05B 3/02; E05B 3/04; E05B 3/08; E05B 2009/046; E05B 13/002; E05B 13/004; E05B 13/10; E05B 13/105; E05B 13/106; E05B 13/108; E05B 15/0013; E05B 15/0033; E05B 15/08; E05B 17/0004; E05B 17/0012
See application file for complete search history.

(56) References Cited

U.S. PATENT DOCUMENTS 191,363 A * 5/1877 Naylor ..... E05B 3/04 292/353
562,419 A * 6/1896 Richards ..... E05B 3/04 292/355
(Continued)

FOREIGN PATENT DOCUMENTS

CN 2533225 Y 1/2003
CN 2821056 Y 9/2006
(Continued)

*Primary Examiner* — Christopher J Boswell
(74) *Attorney, Agent, or Firm* — Winston Hsu

(57) ABSTRACT

A rotating cylinder applied to a lock is disclosed. The rotating cylinder is configured to guide a transmission element of the lock and defining a central axis. The rotating cylinder includes an opening, an inner wall, a first guiding structure, a second guiding structure and an engaging groove. The inner wall is communicated with the opening. The first guiding structure is formed on the inner wall and includes a first curved surface. The second guiding structure is formed on the inner wall and opposite to the first guiding structure. The second guiding structure includes a first curved surface. The engaging groove is formed between the first guiding structure and the second guiding structure. The first curved surface of the first guiding structure and the first curved surface of the second guiding structure are closer to the opening than the engaging groove.

28 Claims, 13 Drawing Sheets

(51) Int. Cl.

| | |
|---|---|
| ***E05B 17/00*** | (2006.01) |
| ***E05B 15/08*** | (2006.01) |
| ***E05B 13/10*** | (2006.01) |
| ***E05B 13/00*** | (2006.01) |
| *E05B 9/04* | (2006.01) |

(52) U.S. Cl.
CPC ..... *E05B 15/0033* (2013.01); *E05B 15/08* (2013.01); *E05B 17/0012* (2013.01); *E05B 17/0004* (2013.01); *E05B 2009/046* (2013.01)

(56) References Cited

U.S. PATENT DOCUMENTS

| | | | | |
|---|---|---|---|---|
| 2,701,735 | A * | 2/1955 | Segal | E05B 3/04 292/348 |
| 3,602,539 | A * | 8/1971 | James | E05B 3/04 403/345 |
| 6,929,290 | B2 * | 8/2005 | Don | E05B 55/005 292/DIG. 60 |
| 8,479,544 | B2 * | 7/2013 | Liu | E05B 55/005 292/336.3 |
| 9,115,509 | B2 * | 8/2015 | Huang | E05B 3/00 |
| 2004/0123427 | A1 * | 7/2004 | Lee | E05B 3/003 16/412 |
| 2005/0046204 | A1 * | 3/2005 | Lin | E05B 3/003 292/358 |

FOREIGN PATENT DOCUMENTS

| | | | |
|---|---|---|---|
| CN | 203769437 | U | 8/2014 |
| CN | 209761012 | U | 12/2019 |
| GB | 861002 | | 2/1961 |
| KR | 10-1996048 | B1 | 7/2019 |
| TW | M409282 | U1 | 8/2011 |
| TW | M434816 | U1 | 8/2012 |
| WO | 2017/165642 | A1 | 9/2017 |

* cited by examiner

ROTATING CYLINDER AND LOCK

BACKGROUND OF THE INVENTION

1. Field of the Invention

The present disclosure relates to a rotating cylinder and a lock, and more particularly, to a rotating cylinder with a guiding structure disposed therein for facilitating assembling of a transmission element and a lock having the rotating cylinder.

2. Description of the Prior Art

A typical lock includes an exterior handle set, an interior handle set, a latch mechanism and a transmission element, wherein the transmission element passes through the latch mechanism, and two ends of the transmission element are connected with the exterior handle set and the interior handle set, respectively. Take the lock with rotary button as an example, the interior handle set thereof includes a rotating cylinder and a rotary button. The rotary button is connected to and synchronously movable with the rotating cylinder. An engaging groove is formed in the rotating cylinder. The transmission element is inserted in the engaging groove, such that the transmission element and the rotating cylinder are capable of rotating synchronously. When a user rotates the rotary button of the interior handle set, the rotating cylinder is brought to rotate synchronously, which brings the transmission element to rotate synchronously, such that the lock is capable of being switched between a locked state and an unlocked state.

When assembling the lock, the user usually assembles an end of the transmission element with the exterior handle set, and then mounts the latch mechanism and the exterior handle set with the transmission element on the door. Afterwards, the engaging groove of the rotating cylinder of the interior handle set is aligned with another end of the transmission element to insert the transmission element in the engaging groove. Then the interior handle set and the exterior handle set are aligned with each other and are connected by fastening members.

However, the cross sections of the engaging groove and the transmission element are usually formed in a rectangular shape, and there is an axial distance between the engaging groove and the opening of the rotating cylinder, it is difficult for the user to directly observe the engaging groove from the outside of the interior handle set, which causes the difficulty of aligning the engaging groove with the transmission element. When the cross section of the engaging groove is formed in a cross shape, and the cross section of the transmission element is formed in a rectangular shape, it is difficult to align the engaging groove with the transmission element. Further, it tends to assemble the engaging groove and the transmission element in an incorrect direction, which is usually found when the assembling is completed. That is, when the assembling is completed, the rotary button can be operated, but the locked position/unlocked position is incorrect. Furthermore, not only the engaging groove and the transmission element are required to be aligned, but also the interior handle set and the exterior handle set are required to be aligned. In other words, when assembling the lock, there are multiple parts required to be aligned, which increases the assembling difficulty.

SUMMARY OF THE INVENTION

According to an embodiment of the present disclosure, a rotating cylinder applied to a lock is disclosed. The rotating cylinder is configured to guide a transmission element of the lock. The rotating cylinder defines a central axis. The rotating cylinder includes an opening, an inner wall, a first guiding structure, a second guiding structure and an engaging groove. The inner wall is communicated with the opening. The first guiding structure is formed on the inner wall and includes a first curved surface. The second guiding structure is formed on the inner wall and opposite to the first guiding structure. The second guiding structure includes a first curved surface. The engaging groove is formed between the first guiding structure and the second guiding structure. The first curved surface of the first guiding structure and the first curved surface of the second guiding structure are closer to the opening than the engaging groove. When assembling the transmission element and the rotating cylinder, the first curved surface of the first guiding structure and the first curved surface of the second guiding structure guide the transmission element to enter the engaging groove.

According to another embodiment of the present disclosure, a rotating cylinder applied to a lock is disclosed. The rotating cylinder is configured to guide a transmission element of the lock. The rotating cylinder defines a central axis. The rotating cylinder includes an opening, an inner wall, a first guiding structure and an engaging groove. The inner wall is communicated with the opening. The first guiding structure is formed on the inner wall and includes a first curved surface and a second curved surface. The first curved surface and the second curved surface are extended in opposite directions. The engaging groove is formed in the rotating cylinder. The first curved surface and the second curved surface of the first guiding structure are closer to the opening than the engaging groove. When assembling the transmission element and the rotating cylinder, the first curved surface or the second curved surface of the first guiding structure guides the transmission element to enter the engaging groove.

According to yet another embodiment of the present disclosure, a lock includes an interior handle, the aforementioned rotating cylinder, a transmission element and a rotary button. The rotating cylinder is disposed in the interior handle in a relatively rotatable manner, and an end of the rotating cylinder protrudes from the interior handle. The transmission element is inserted in the engaging groove of the rotating cylinder. The rotary button is disposed on the end of the rotating cylinder. When the rotating cylinder is operated to rotate relative to the interior handle, the lock is capable of being switched between a locked state and an unlocked state.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the embodiments, reference is made to the accompanying drawings which form a part thereof, and in which is shown by way of illustration specific embodiments in which the disclosure may be practiced. In this regard, directional terminology, such as top, bottom, left, right, front or back, is used with reference to the orientation of the Figure (s) being described. The components of the present disclosure can be positioned in a number of different orientations. As such, the directional terminology is used for purposes of illustration and is in no way limiting. In addition, identical components or similar numeral references are used for identical components or similar components in the following embodiments. Accordingly, the drawings and descriptions will be regarded as illustrative in nature and not as restrictive.

Figure 1:
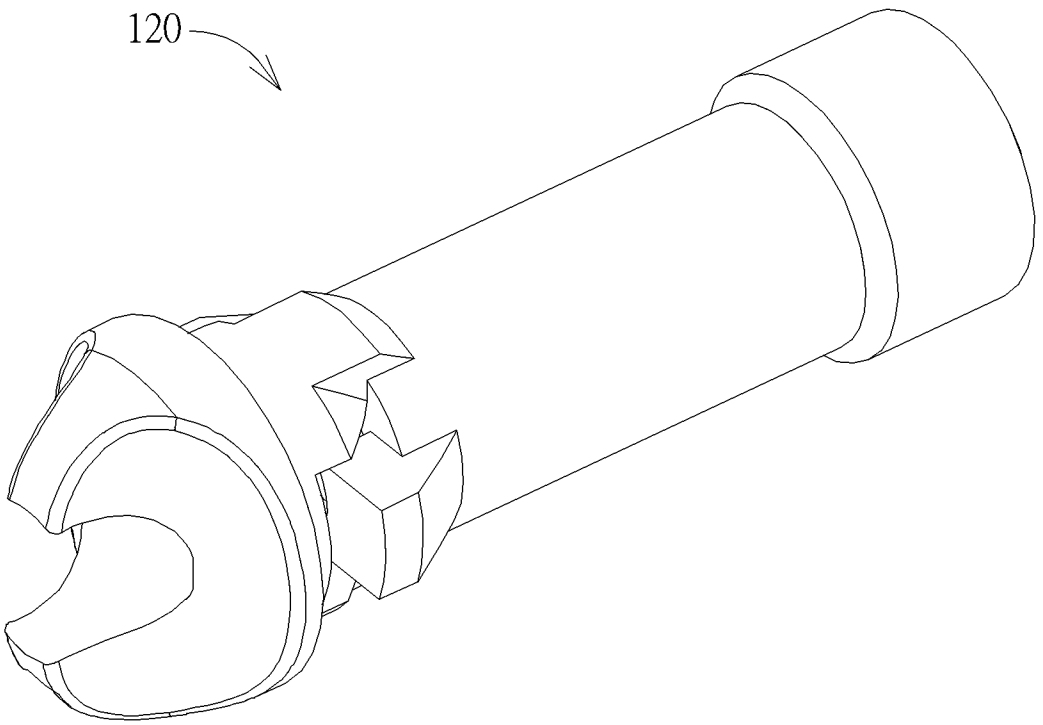
FIG. 1 is a three-dimensional diagram showing a rotating cylinder according to one embodiment of the present disclosure.
Figure 2:
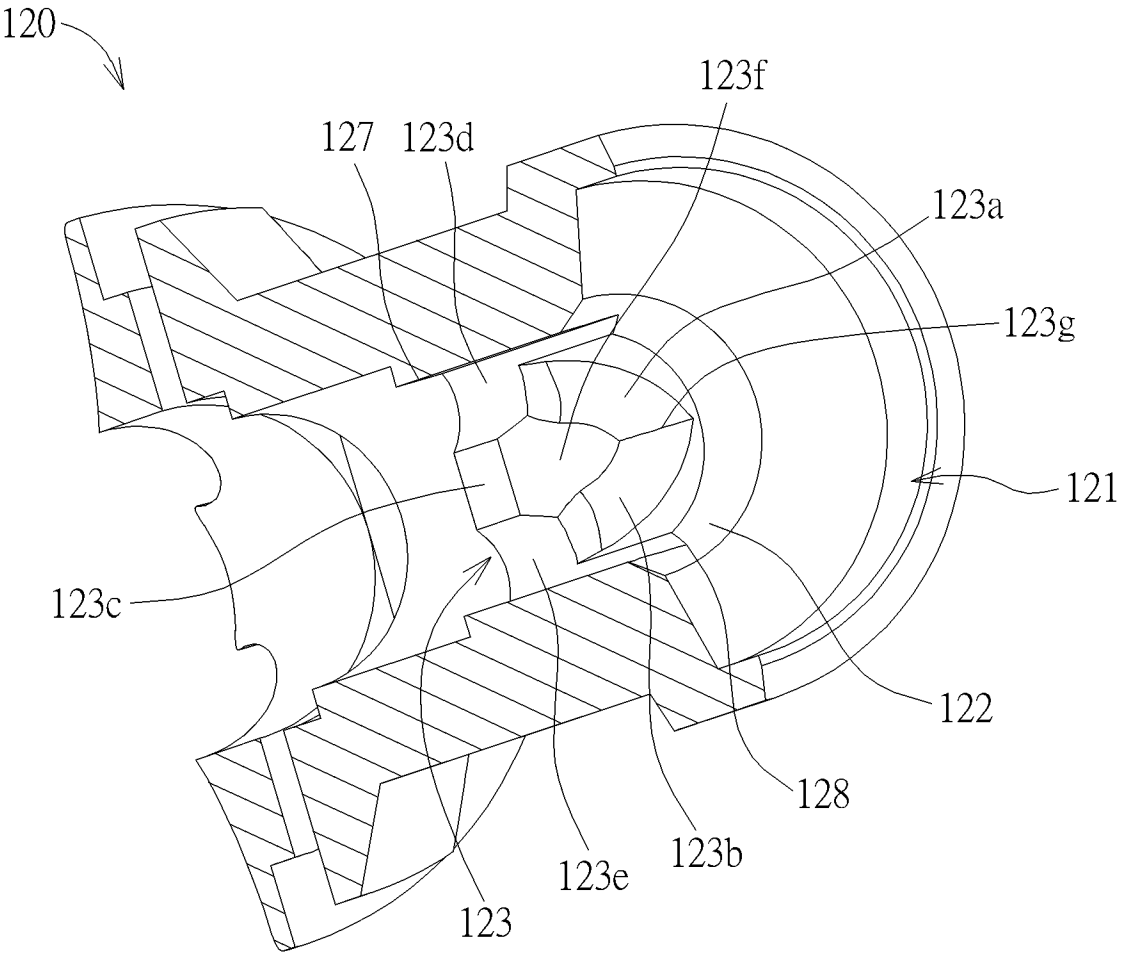
FIG. 2 is a three-dimensional diagram showing a half of the rotating cylinder of FIG. 1.

Please refer to FIG. 1 to FIG. 4, wherein FIG. 2 only draws half of structures of the rotating cylinder 120 for clearly showing an inner structure of the rotating cylinder 120. The present disclosure provides a rotating cylinder 120. The rotating cylinder 120 defines a central axis O. The rotating cylinder 120 includes an opening 121, an inner wall 122, a first guiding structure 123, a second guiding structure 124 and an engaging groove 125. The inner wall 122 is communicated with the opening 121. The first guiding structure 123 is formed on the inner wall 124. The first guiding structure 123 includes a first curved surface 123*a*. The second guiding structure 124 is formed on the inner wall 122 and is opposite to the first guiding structure 123. The second guiding structure 124 includes a first curved surface 124*a*. The engaging groove 125 is formed between the first guiding structure 123 and the second guiding structure 124. The first curved surface 123*a* of the first guiding structure 123 and the first curved surface 124*a* of the second guiding structure 124 are closer to the opening 121 than the engaging groove 125.

Figure 5:
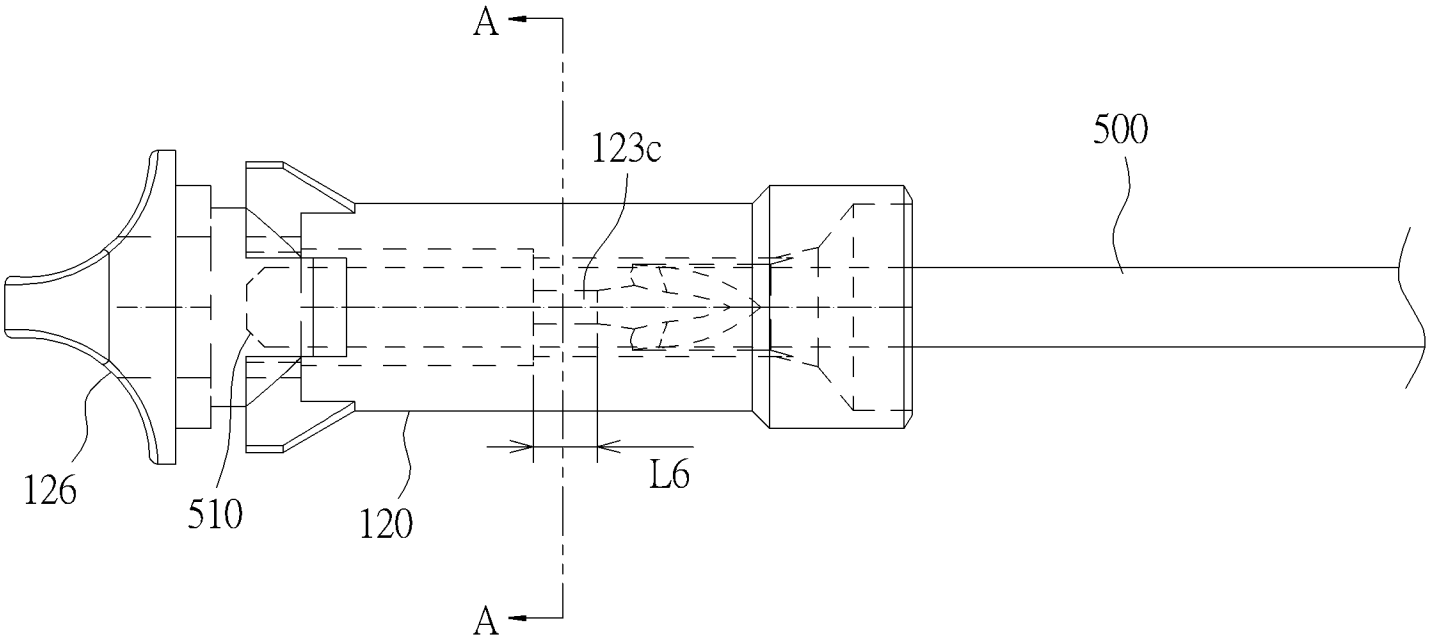
FIG. 5 is a schematic diagram showing the rotating cylinder of FIG. 1 and a transmission element in an assembled state.
Figure 6:
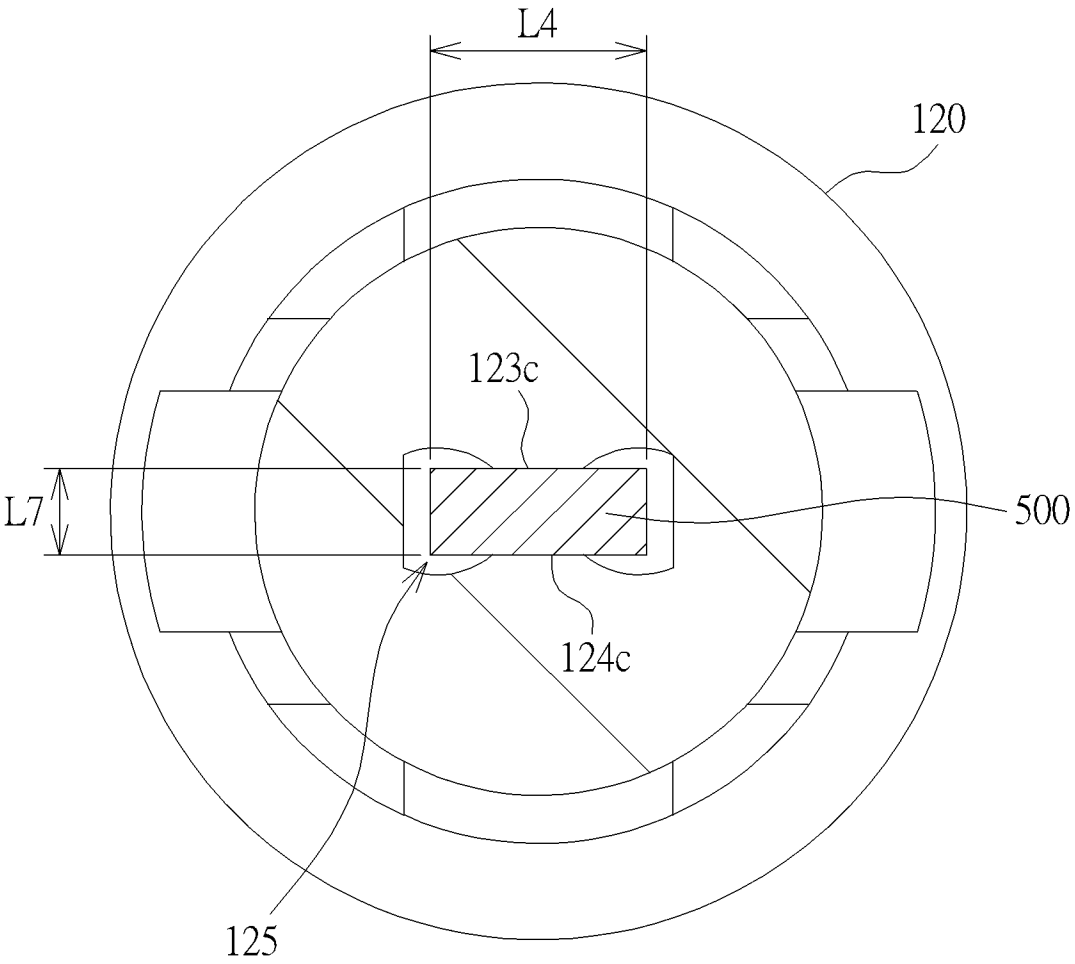
FIG. 6 is a cross-sectional view of the transmission element and the rotating cylinder taken along line A-A in FIG. 5.
Figure 11:
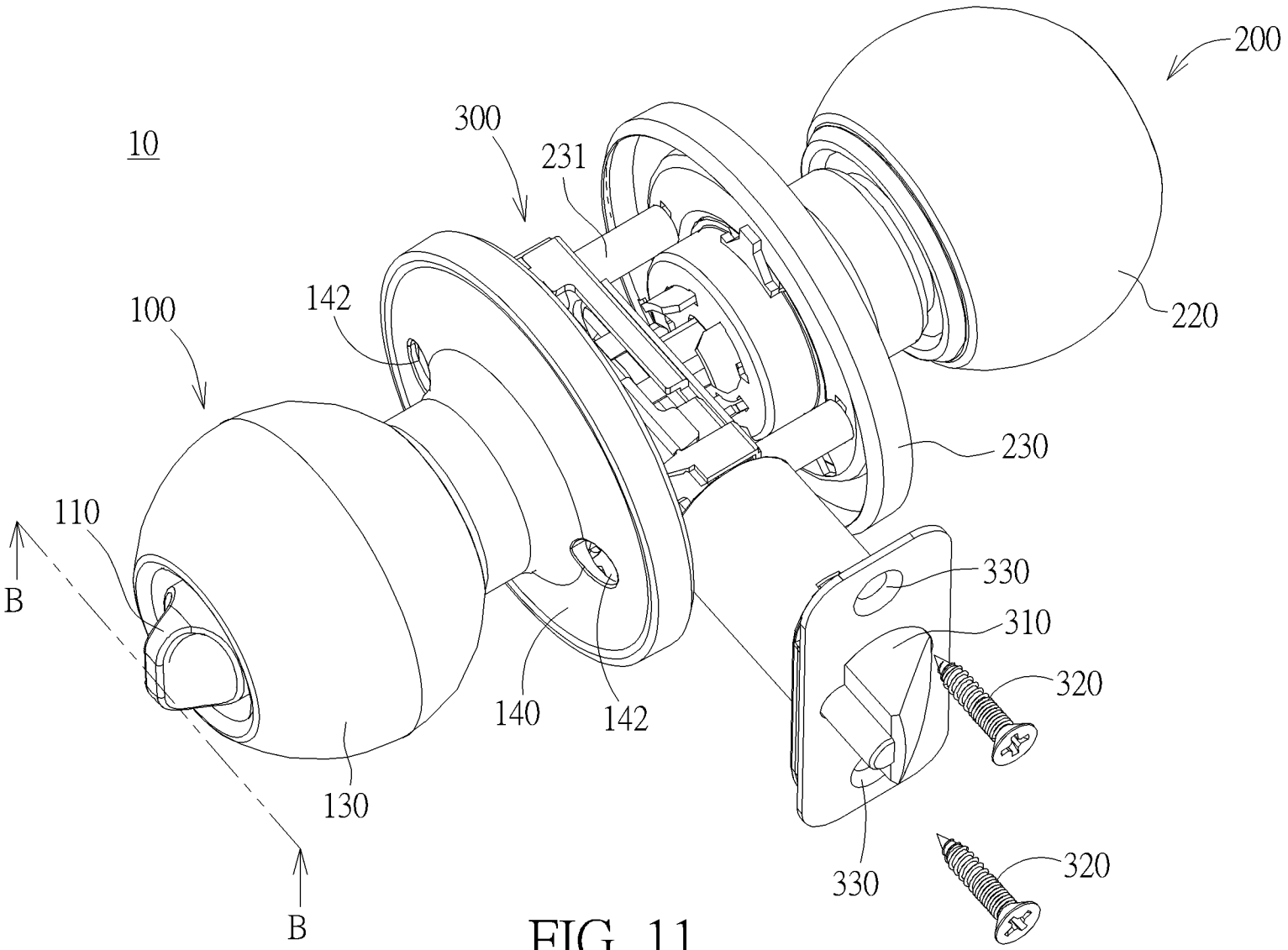
FIG. 11 is a three-dimensional diagram showing a lock according to one embodiment of the present disclosure.
Figure 12:
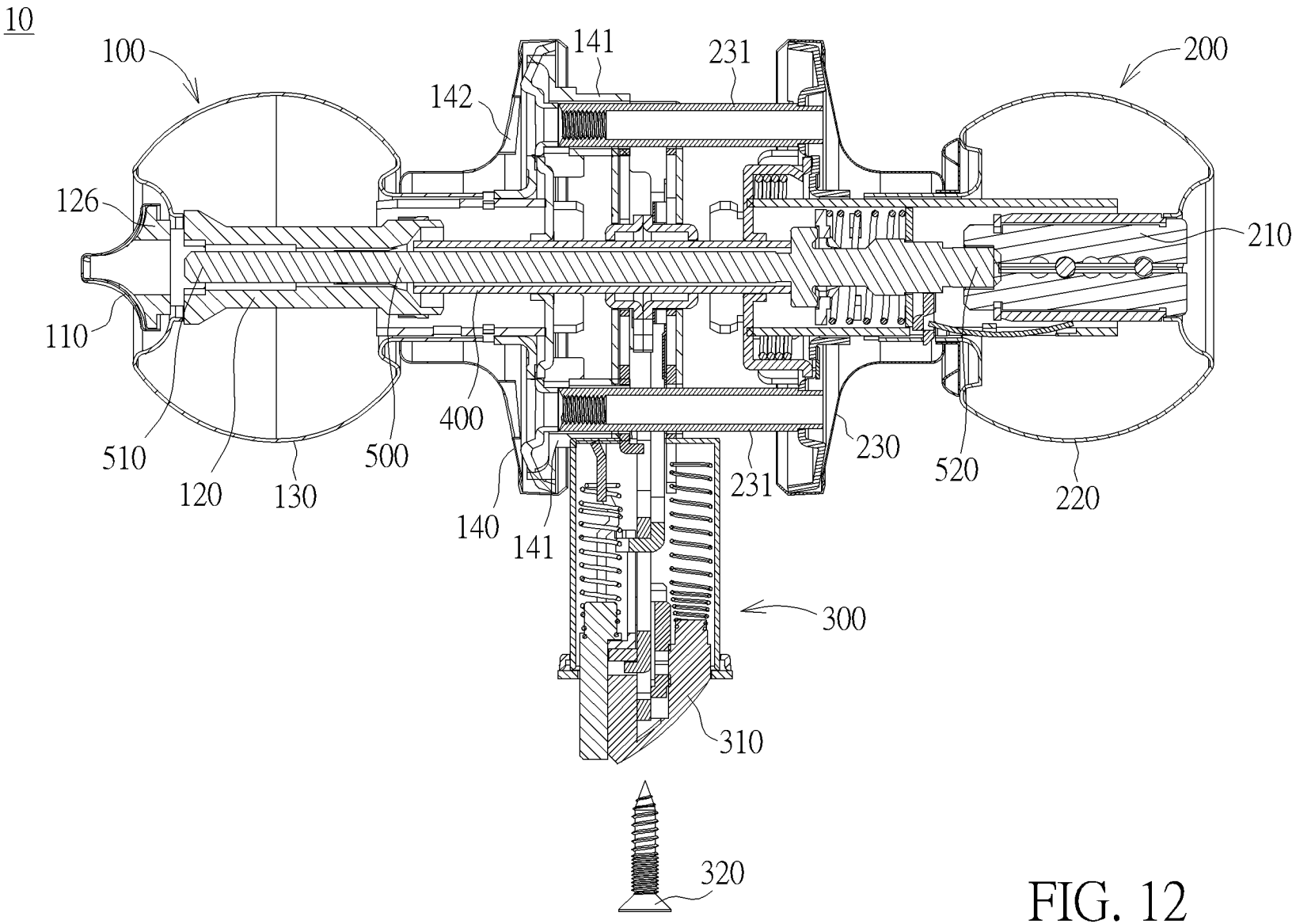
FIG. 12 is a cross-sectional view of the lock taken along line B-B in FIG. 11.
Figure 13:
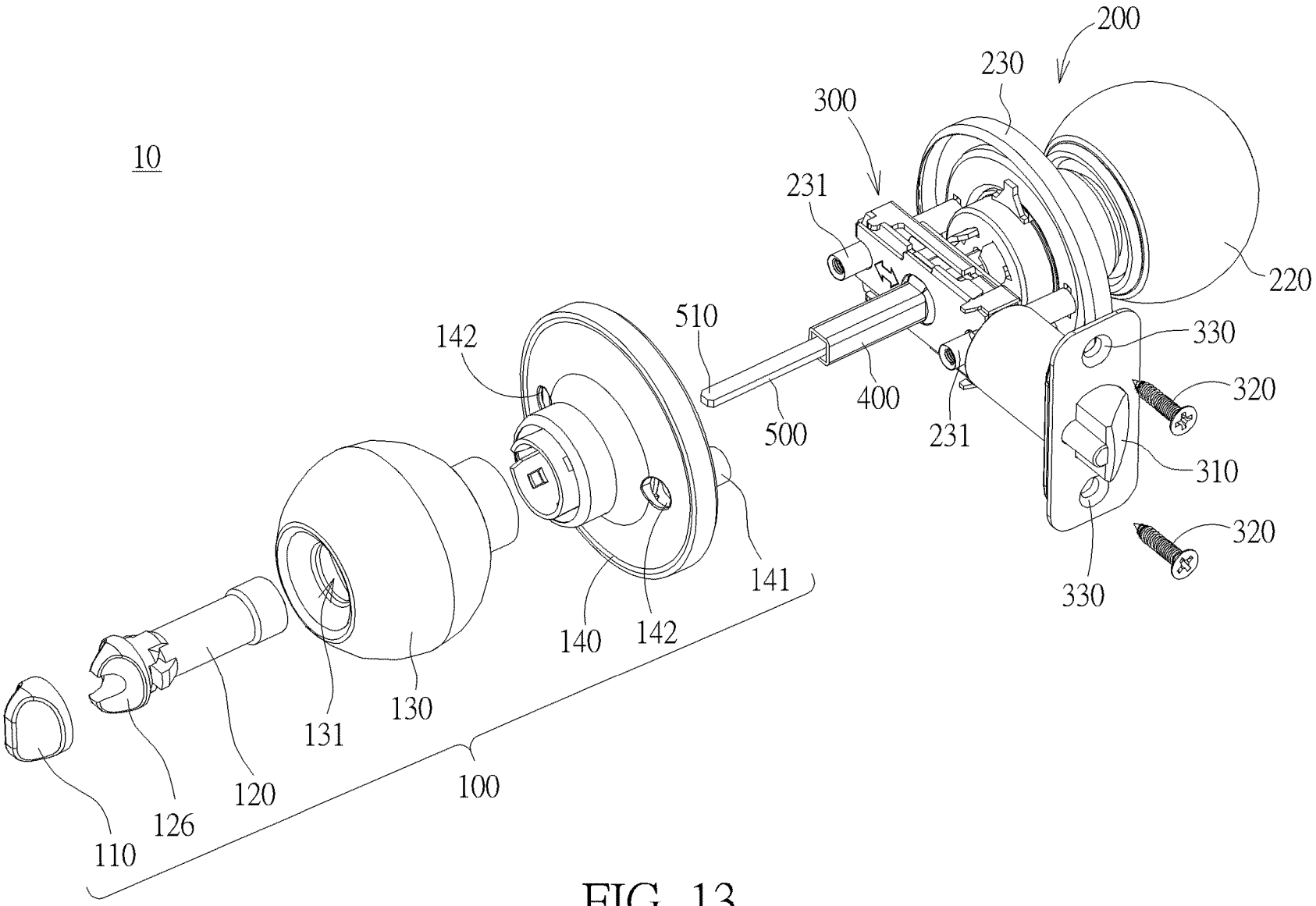
FIG. 13 is an exploded diagram showing the lock of FIG. 11.

The rotating cylinder 120 can be applied to a lock 10 (see FIG. 11 to FIG. 13). The rotating cylinder 120 is configured to guide a transmission element 500 of the lock 10 (see FIG. 12 and FIG. 13). The transmission element 500 can be guided by the rotating cylinder 120 to insert in the engaging groove 125. As shown in FIG. 5 and FIG. 6, when the transmission element 500 and the rotating cylinder 120 are in an assembled state, the transmission element 500 is inserted in the engaging groove 125.

Figure 7:
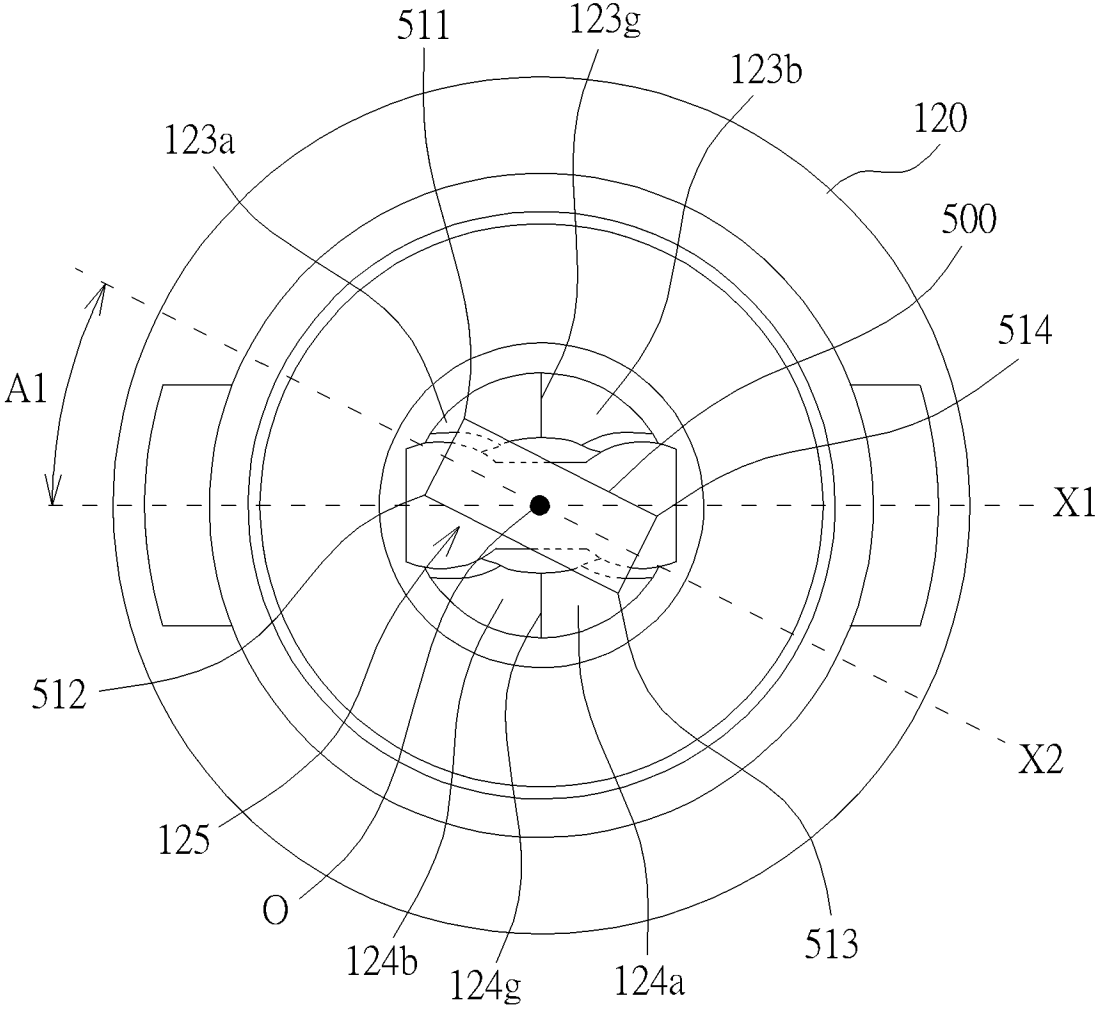
FIG. 7 is a schematic diagram showing the assembling of the transmission element and the rotating cylinder of FIG. 5.
Figure 8:
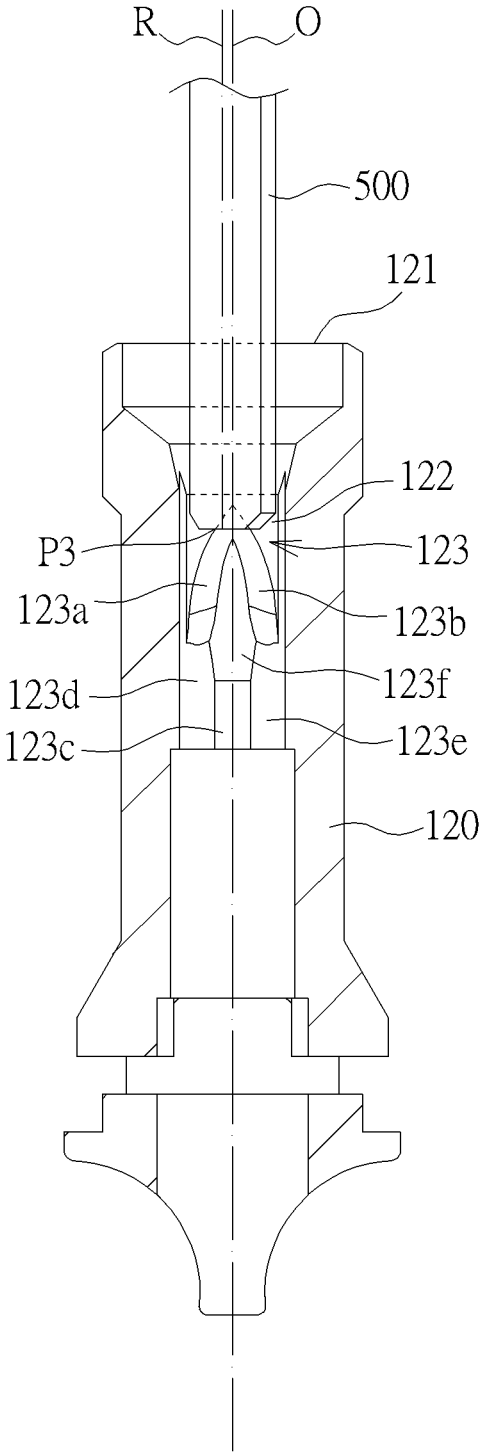
FIG. 8 is a schematic diagram showing the assembling of the transmission element and the rotating cylinder of FIG. 7 in another view angle.
Figure 9:
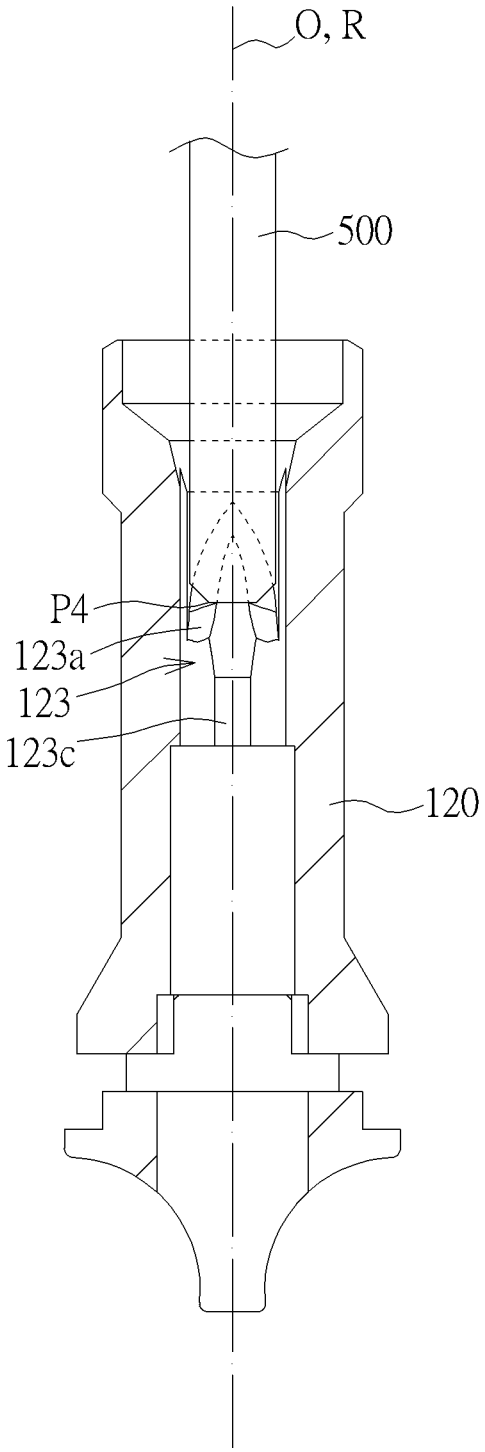
FIG. 9 is another schematic diagram showing the assembling of the transmission element and the rotating cylinder of FIG. 7.

Please refer to FIG. 7 to FIG. 9, when assembling the transmission element 500 and the rotating cylinder 120, an end of the transmission element 500 is operated to insert in the engaging groove 125 of the rotating cylinder 120. When the transmission element 500 is operated to enter the rotating cylinder 120 from the opening 121 and is not aligned with the engaging groove 125, as shown in FIG. 7 and FIG. 8, a deviation angle A1 is between the transmission element 500 and the rotating cylinder 120, and the transmission element 500 contacts the first guiding structure 123 and the second guiding structure 124. FIG. 7 and FIG. 8 exemplarily show that the transmission element 500 contacts the first curved surface 123*a* of the first guiding structure 123 and the first curved surface 124*a* of the second guiding structure 124. With the first curved surface 123*a* of the first guiding structure 123 and the first curved surface 124*a* of the second guiding structure 124 together guiding the transmission element 500, the transmission element 500 is rotated when moving along the first curved surfaces 123*a* and 124*a* into the rotating cylinder 120, such that the deviation angle A1 is reduced gradually, and the transmission element 500 is capable of aligning with the engaging groove 125. As shown in FIG. 9, when the deviation angle A1 is 0 degree, the transmission element 500 is capable of entering the engaging groove 125. In other words, when assembling the transmission element 500 of the lock 10 and the rotating cylinder 120, the first curved surface 123*a* of the first guiding structure 123 and the first curved surface 124*a* of the second guiding structure 124 guide the transmission element 500, such that the transmission element 500 is capable of entering the engaging groove 125. As such, when a user assembles the rotating cylinder 120 and the transmission element 500, there is no need to accurately align the engaging groove 125 of the rotating cylinder 120 with the transmission element 500, which can reduce the assembling difficulty significantly.

In the embodiment, the second guiding structure 124 and the first guiding structure 123 are symmetrical to each other about the central axis O. Therefore, the structural details of the first guiding structure 123 and the second guiding structure 124 are provided below by using the first guiding structure 123 as an example. For details of the elements of the second guiding structure 124, references can be made to the elements having the same name in the first guiding structure 123.

Figure 3:
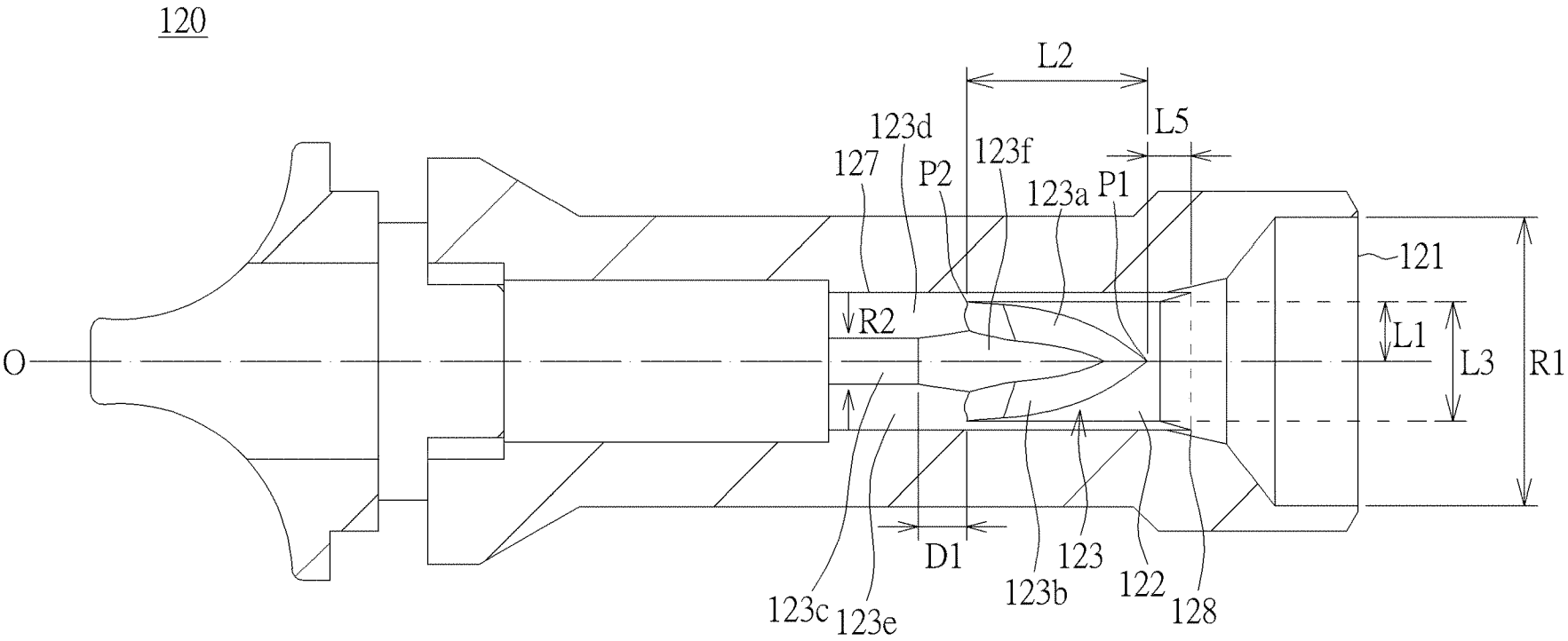
FIG. 3 is a cross-sectional view showing the rotating cylinder of FIG. 1.
Figure 4:
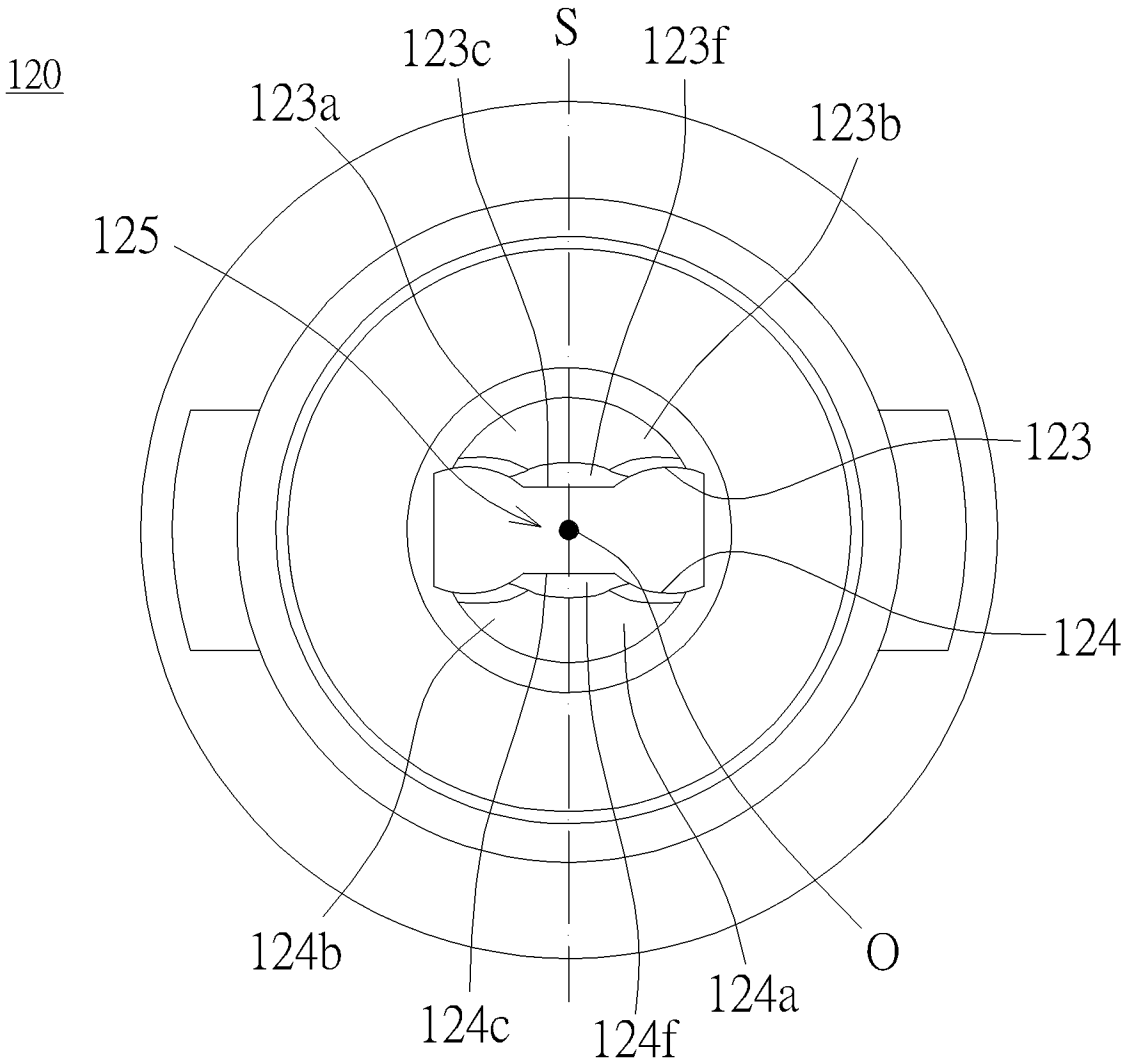
FIG. 4 is a plane view showing the rotating cylinder of FIG. 1.

Specifically, as shown in FIG. 2 to FIG. 4, the rotating cylinder 120 can further include a narrow section 127 communicated with the opening 121. The first guiding structure 123 and the second guiding structure 124 are disposed on the narrow section 127. An inner diameter R2 of the narrow section 127 is smaller than an inner diameter R1 of the opening 121. The first guiding structure 123 can further include a second curved surface 123*b*. The second curved surface 123*b* and the first curved surface 123*a* of the first guiding structure 123 can be connected with each other. The second curved surface 123*b* and the first curved surface 123*a* of the first guiding structure 123 can be extended in opposite directions. The second guiding structure 124 can further include a second curved surface 124*b*. The second curved surface 124*b* and the first curved surface 124*a* of the second guiding structure 124 can be connected with each other. The second curved surface 124*b* and the first curved surface 124*a* of the second guiding structure 124 can be extended in opposite directions. As such, when a deviation angle A1 along a clockwise direction (shown in FIG. 7) or a deviation angle A1 along a counterclockwise direction (not shown) is between the transmission element 500 and the rotating cylinder 120 when assembling the transmission element 500 and the rotating cylinder 120, the transmission element 500 can be guided by the first curved surfaces 123*a* and 124*a* or guided by the second curved surfaces 123*b* and 124*b* to align with the engaging groove 125. The first curved surface 123*a* and the second curved surface 123*b* of the first guiding structure 123 can be mirror symmetric. The first curved surface 124*a* and the second curved surface 124*b* of the second guiding structure 124 can be mirror symmetric. Specifically, the first curved surface 123*a* and the second curved surface 123*b* of the first guiding structure 123 can be mirror symmetric about a plane S, and the first curved surface 124*a* and the second curved surface 124*b* of the second guiding structure 124 can be mirror symmetric about the plane S. As such, the structure configuration of the rotating cylinder 120 can be simplified, and the guide provided to the transmission element 500 by the rotating cylinder 120 can be more evenly.

AS shown in FIG. 4, the first curved surface 123*a* of the first guiding structure 123 and the first curved surface 124*a* of the second guiding structure 124 can be symmetrical to each other about the central axis O, the second curved surface 123*b* of the first guiding structure 123 and the second curved surface 124*b* of the second guiding structure 124 can be symmetrical to each other about the central axis O. As such, the guide provided to the transmission element 500 by the first guiding structure 123 and the second guiding structure 124 can be more evenly.

As shown in FIG. 2 to FIG. 4, the first guiding structure 123 can further include an abutting surface 123*c*, the second guiding structure 124 can further include an abutting surface 124*c*, and the abutting surface 123*c* of the first guiding structure 123 and the abutting surface 124*c* of the second guiding structure 124 define the engaging groove 125. In other words, the abutting surface 123*c* of the first guiding structure 123 is corresponding to the engaging groove 125, and the abutting surface 124*c* of second guiding structure 124 is corresponding to the engaging groove 125. The first curved surface 123*a* is closer to the opening 121 than the abutting surface 123*c*, the first curved surface 124*a* is closer to the opening 121 than the abutting surface 124*c*, such that the engaging groove 125 is farther away from the opening 121 than the first curved surface 123*a* of the first guiding structure 123 and the first curved surface 124*a* of the second guiding structure 124.

The first guiding structure 123 can further include at least one dodging surface (123*d*-123*f*). The dodging surface (123*d*-123*f*) is connected with the abutting surface 123*c* of the first guiding structure 123. When assembling the transmission element 500 and the rotating cylinder 120, the dodging surface (123*d*-123*f*) and the transmission element 500 do not interfere with each other. Specifically, the first guiding structure 123 includes three dodging surfaces, which are a first dodging surface 123*d*, a second dodging surface 123*e* and a third dodging surface 123*f*, respectively. The first dodging surface 123*d* is connected between the first curved surface 123*a* and the abutting surface 123*c*, the second dodging surface 123*e* is connected between the second curved surface 123*b* and the abutting surface 123*c*, and the third dodging surface 123*f* is connected between the first curved surface 123*a*, the second curved surface 123*b* and the abutting surface 123*c*. A spaced distance Dl is between the abutting surface 123*c* and the first curved surface 123*a* along the central axis O. That is, the first curved surface 123*a* is not directly connected with the abutting surface 123*c*, but is connected with the abutting surface 123*c* through the first dodging surface 123*d* and the third dodging surface 123*f*. A spaced distance Dl is between the abutting surface 123*c* and the second curved surface 123*b* along the central axis O. That is, the second curved surface 123*b* is not directly connected with the abutting surface 123*c*, but connected with the abutting surface 123*c* through the second dodging surface 123*e* and the third dodging surface 123*f*. When assembling the transmission element 500 and the rotating cylinder 120, the first dodging surface 123*d*, the second dodging surface 123*e* and the third dodging surface 123*f* of the first guiding structure 123 and the transmission element 500 do not interfere with each other.

Similarly, the second guiding structure 124 can further include at least one dodging surface (only 124*f* is shown). The dodging surface (only 124*f* is shown) is connected with the abutting surface 124*c* of the second guiding structure 124. When assembling the transmission element 500 and the rotating cylinder 120, the dodging surface (only 124*f* is shown) and the transmission element 500 do not interfere with each other. In the embodiment, the second guiding structure 124 includes three dodging surfaces, which are a first dodging surface, a second dodging surface and a third dodging surface 124*f*, respectively. The first dodging surface is connected between the first curved surface 124*a* and the abutting surface 124*c*. The second dodging surface is connected between the second curved surface 124*b* and the abutting surface 124*c*. The third dodging surface 124*f* is connected between the first curved surface 124*a*, the second curved surface 124*b* and the abutting surface 124*c*. A spaced distance is between the abutting surface 124*c* and the first curved surface 124*a* along the central axis O. That is, the first curved surface 124*a* is not directly connected with the abutting surface 124*c*, but is connected with the abutting surface 124*c* through the first dodging surface and the third dodging surface 124*f*. A spaced distance is between the abutting surface 124*c* and the second curved surface 124*b* along the central axis O. That is, the second curved surface 124*b* is not directly connected with the abutting surface 124*c*, but is connected with the abutting surface 124*c* through the second dodging surface and the third dodging surface 124*f*. When assembling the transmission element 500 and the rotating cylinder 120, the first dodging surface, the second dodging surface and the third dodging surface 124*f* of the second guiding structure 124 do not interfere with the transmission element 500. With the dodging surface disposed on the first guiding structure 123 and the second guiding structure 124, the smoothness when the transmission element 500 is guided to the engaging groove 125 can be enhanced.

Please refer to FIG. 7. A cross section of the transmission element 500 can be rectangular and includes corner portions 511, 512, 513 and 514. The corner portion 511 is opposite to the corner portion 513, and the corner portion 512 is opposite to the corner portion 514. When the deviation angle A1 (shown in FIG. 7) along the clockwise direction is between the transmission element 500 and the rotating cylinder 120 during assembling the transmission element 500 and the rotating cylinder 120, the first curved surface 123*a* of the first guiding structure 123 guides the corner portion 511, and the first curved surface 124*a* of the second guiding structure 124 guides the corner portion 513. Alternatively, when a deviation angle (not shown) along the counterclockwise direction is between the transmission element 500 and the rotating cylinder 120 during assembling the transmission element 500 and the rotating cylinder 120, the second curved surface 123*b* of the first guiding structure 123 guides the corner portion 514, and the second curved surface 124*b* of the second guiding structure 124 guides the corner portion 512. In other words, the transmission element 500 can include two corner portions opposite to each other (511 and 513, or 512 and 514), the first curved surface 123*a* of the first guiding structure 123 guides one of the two corner portions, and the first curved surface 124*a* of the second guiding structure 124 guides the other one of the two corner portions. In other embodiment, the cross section of the transmission element 500 can be formed in other shapes, such as elongated ellipse (for example, straight lines of longer sides of the cross section of the transmission element 500 in FIG. 7 can be replaced by curved lines), and the number of the guiding structure can be adjusted according to the cross section of the transmission element 500.

As shown in FIG. 7, the deviation angle A1 is between the transmission element 500 and the rotating cylinder 120 when assembling the transmission element 500 and the rotating cylinder 120, and the deviation angle A1 is greater than 0 degree and less than 90 degrees, the transmission element 500 can be guided by the first guiding structure 123 and the second guiding structure 124 to align with the engaging groove 125. The deviation angle A1 can be an included angle between a length extending direction X1 passing a central point of the engaging groove 125 and a length extending direction X2 passing a central point of the transmission element 500. More specifically, when the deviation angle A1 is equal to 0 degree, the transmission element 500 is align with the engaging groove 125 and can directly enter the engaging groove 125 without being guided. When the deviation angle A1 is equal to 90 degrees, the transmission element 500 happens to contact the boundary 123*g* connecting the first curved surface 123*a* and the second curved surface 123*b* and the boundary 124*g* connecting the first curved surface 124*a* and the second curved surface 124*b*. The boundaries 123*g* and 124*g* are located at the ridge and are incapable of guiding. However, the user only needs to rotate the transmission element 500 slightly, such that the transmission element 500 can be deviated from the ridge and enter the range that can be guided. In other words, as long as the deviation angle A1 is greater than 0 degree and less than 90 degrees, the transmission element 500 can be guided to enter the engaging groove 125. Therefore, the present disclosure has advantage of large guiding range, which can reduce the assembling difficulty of the transmission element 500 and the rotating cylinder 120 significantly.

Please refer to FIG. 3, when a distribution length of the first curved surface 123*a* perpendicular to the central axis O is L1, and a distribution length of the first curved surface 123*a* parallel to the central axis O is L2, the following condition can be satisfied: $0.025<L1/L2<2$. As such, the smoothness when the transmission element 500 is guided to the engaging groove 125 can be enhanced. Preferably, the following condition can be satisfied: $0.5<L1/L2<1$. Furthermore, the following condition can be satisfied: 1 mm<L1<10 mm. Preferably, the following condition can be satisfied: 2 mm<L1<5 mm. L1 can be a spaced distance from a start point P1 of the first curved surface 123*a* to an end point P2 of the first curved surface 123*a* along a direction perpendicular to the central axis O. L2 can be a spaced distance from the start point P1 of the first curved surface 123*a* to the end point P2 of the first curved surface 123*a* along a direction parallel to the central axis O.

Please refer to FIG. 3 and FIG. 6, when a distribution length of the first guiding structure 123 perpendicular to the central axis O is L3, and a width of the transmission element 500 is L4, the following condition can be satisfied: $1<L3/L4<1.2$. As such, the success rate of guiding the transmission element 500 can be enhanced. Please refer to FIG. 7 and FIG. 8, when the deviation angle A1 is between the transmission element 500 and the rotating cylinder 120 during assembling the transmission element 500 and the rotating cylinder 120, the central axis R of the transmission element 500 and the central axis O of the rotating cylinder 120 may not be coaxial with each other (also called eccentric). Please refer to FIG. 8 and FIG. 9, during the process that the transmission element 500 moves from a point P3 on the first curved surface 123*a* to a point P4 on the first curved surface 123*a*, the transmission element 500 is guided by the first curved surfaces 123*a* and 124*b*, such that the deviation angle A1 is reduced gradually, and the central axis R of the transmission element 500 and the central axis O of the rotating cylinder 120 are getting coaxial (also called concentric). When L3/L4 is excessively large, the eccentric degree between the transmission element 500 and the rotating cylinder 120 may be serious when the transmission element 500 is just inserted in the rotating cylinder 120, which is unfavorably for the transmission element 500 and the rotating cylinder 120 becoming concentric during the guiding process.

Please refer to FIG. 3, a minimum spaced distance between an end 128 of the narrow section 127 closer to the opening 121 and the first guiding structure 123 parallel to the central axis O is L5, the following condition can be satisfied: 0.5 mm<L5<10 mm. As such, it can prevent the transmission element 500 from getting stuck when the transmission element 500 just enters the rotating cylinder 120. Preferably, the following condition can be satisfied: 1 mm<L5<3 mm.

Figure 10:
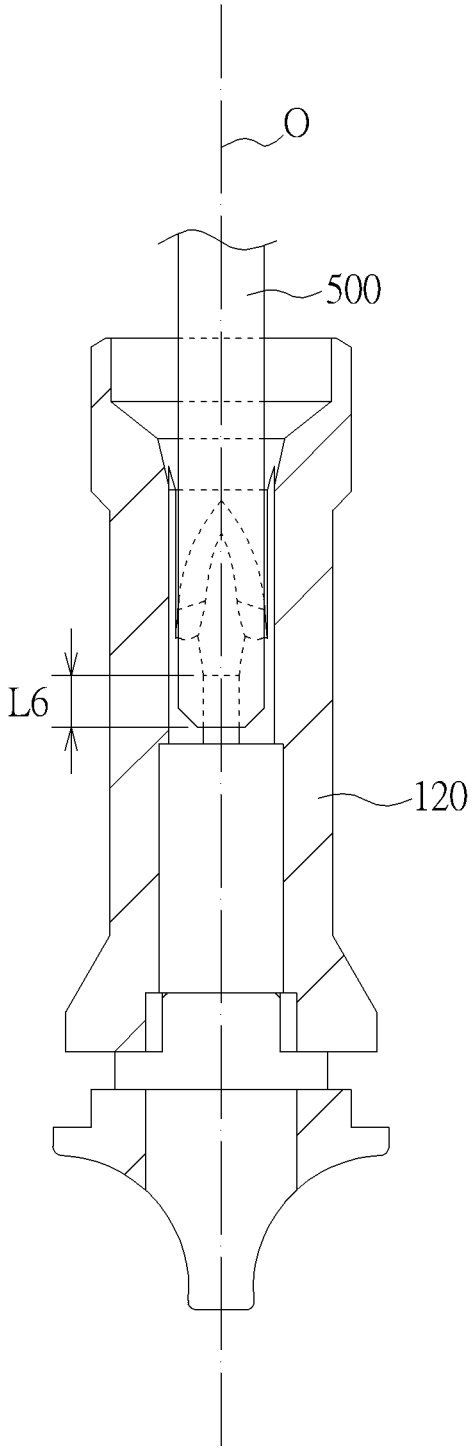
FIG. 10 is a schematic diagram showing a rotating cylinder and a transmission element in an assembled state according to another embodiment.

Please refer to FIG. 5, when the transmission element 500 and the rotating cylinder 120 are in an assembled state, an abutting length between the transmission element 500 and the abutting surface 123*c* parallel to the central axis O is L6, the following condition can be satisfied: L6≥3 mm. As such, the abutting length between the transmission element 500 and the rotating cylinder 120 is sufficient, and the transmission element 500 and the rotating cylinder 120 are capable of rotating synchronously. In the embodiment, the transmission element 500 passes through the engaging groove 125 and is close to an end 126 of the rotating cylinder 120 opposite to the opening 121. Therefore, L6 is equal to the length of the abutting surface 123*c* parallel to central axis O. However, the present disclosure is not limited thereto. In other embodiment, as shown in FIG. 10, the length of the transmission element 500 can be shorter and does not pass through the engaging groove 125.

Please refer to FIG. 6, a thickness L7 of the transmission element 500 is corresponding to a size of the engaging groove 125, such that the transmission element 500 can be engaged in the engaging groove 125. As such, the transmission element 500 and the rotating cylinder 120 are capable of rotating synchronously.

In the embodiment, the rotating cylinder 120 is disposed with the first guiding structure 123 and the second guiding structure 124 and guides the transmission element 500 with the first curved surface 123*a* of the first guiding structure 123 and the first curved surface 124*a* of the second guiding structure 124. However, in other embodiment, the rotating cylinder 120 can only include the first guiding structure 123 or the second guiding structure 124. For example, when the rotating cylinder 120 only includes the first guiding structure 123, which can refer to FIG. 2 and FIG. 3, the rotating cylinder 120 defines the central axis O, the rotating cylinder 120 includes the opening 121, the inner wall 122, the first guiding structure 123 and the engaging groove 125. The inner wall 122 is communicated with the opening 121. The first guiding structure 123 is formed on the inner wall 122. The first guiding structure 123 includes the first curved surface 123*a* and the second curved surface 123*b*. The first curved surface 123*a* and the second curved surface 123*b* are extended in opposite directions. The engaging groove 125 is formed in the rotating cylinder 120. The first curved surface 123*a* and the second curved surface 123*b* of the first guiding structure 123 are closer to the opening 121 than the engaging groove 125. When assembling the transmission element 500 and the rotating cylinder 120, the first curved surface 123*a* or the second curved surface 123*b* of the first guiding structure 123 guides the transmission element 500 to enter the engaging groove 125. Specifically, when assembling the transmission element 500 and the rotating cylinder 120, a deviation angle A1 is between the transmission element 500 and the rotating cylinder 120, and deviation angle A1 is greater than 0 degree and less than 90 degrees, the transmission element 500 contacts one of the first curved surface 123*a* and the second curved surface 123*b* (the portion can refer to the description relevant to FIG. 7). As such, the transmission element 500 is guided by one of the first curved surface 123*a* and the second curved surface 123*b* to enter the engaging groove 125. Other details of the rotating cylinder 120 only including the first guiding structure 123 or the second guiding structure 124 can be the same as that of the rotating cylinder 120 including both the first guiding structure 123 and the second guiding structure 124, and related descriptions are omitted herein.

Please refer to FIG. 11 to FIG. 13, the present disclosure further provides a lock 10. The lock 10 is configured to be mounted on a door (not shown). The lock 10 includes an interior handle set 100, an exterior handle set 200, a latch mechanism. 300, a tube member 400 and the transmission element 500. The interior handle set 100 is disposed on a side of the door. The exterior handle set 200 is disposed on another side of the door. The latch mechanism 300 is disposed between the interior handle set 100 and the exterior handle set 200, and is fixed on the door via two fastening members 320 being locked into two fastening holes 330, respectively. The tube member 400 is passed through the latch mechanism 300, and two ends of the tube member 400 are connected with the interior handle set 100 and the exterior handle set 200, respectively. When an exterior handle 220 of the exterior handle set 200 is rotated, the tube member 400 and an interior handle 130 of the interior handle set 100 are brought to rotate with the exterior handle 220, and the latch tongue 310 of the latch mechanism 300 can be driven by the rotation of the tube member 400. Similarly, when the interior handle 130 of the interior handle set 100 is rotated, the tube member 400 and the exterior handle 220 of the exterior handle set 200 are brought to rotate with the interior handle 130, and the latch tongue 310 of the latch mechanism 300 can be driven by the rotation of the tube member 400. The transmission element 500 is inserted in the tube member 400 in a relatively rotatable manner, and the first end 510 and the second end 520 of the transmission element 500 are connected with the interior handle set 100 and the exterior handle set 200, respectively.

The interior handle set 100 includes a rotary button 110, the rotating cylinder 120, the interior handle 130 and a cover plate 140. The cover plate 140 is fixed on the door. The interior handle 130 is connected with the cover plate 140 in a relatively rotatable manner. The rotating cylinder 120 is disposed in the interior handle 130 in a relatively rotatable manner, and an end 126 of the rotating cylinder 120 protrudes from the interior handle 130. Herein, the end 126 of the rotating cylinder 120 protrudes from the interior handle 130 through the through hole 131 of the interior handle 130. The rotary button 110 is disposed on the end 126 of the rotating cylinder 120. In other embodiment, the rotary button 110 and the rotating cylinder 120 can be integrally formed. Alternatively, the end 126 of the rotating cylinder 120 can be formed in the shape of the rotary button 110, such that the rotary button 110 can be omitted.

The exterior handle set 200 includes a lock member 210, the exterior handle 220 and a cover plate 230. The cover plate 230 is fixed on the door. The exterior handle 220 is connected with the cover plate 230 in a relatively rotatable manner. The lock member 210 is disposed in the exterior handle 220 in a relatively rotatable manner.

The first end 510 of the transmission element 500 is disposed in the rotating cylinder 120. The second end 520 of the transmission element 500 is engaged with the lock member 210. When the rotating cylinder 120 is operated to rotate relative to the interior handle 130, for example, the user rotates the rotary button 110 to bring the rotating cylinder 120 to rotate, the transmission element 500 is brought to rotate by the rotating cylinder 120, and the lock member 210 is capable of being switched between a locked state and an unlocked state. That is, when the rotating cylinder 120 is operated to rotate relative to the interior handle 130, the lock 10 is capable of being switched between a locked state and an unlocked state.

When assembling the lock 10, the second end 520 of the transmission element 500 can be firstly assembled with the exterior handle set 200. Then the latch mechanism 300 and the exterior handle set 200 with the transmission element 500 are mounted on the door. Afterwards, the rotating cylinder 120 of the interior handle set 100 is aligned with the first end 510 of the transmission element 500, and the interior handle set 100 and the exterior handle set 200 are aligned with each other. For example, two pillar structures 141 of the interior handle set 100 are aligned with two screw posts 231 of the exterior handle set 200. Then fastening members (not shown) are inserted through holes 142 and fastened into the screw posts 231, such that the interior handle set 100 and the exterior handle set 200 are fixedly connected with each other. In the case that the rotating cylinder 120 includes both the first guiding structure 123 and the second guiding structure 124, when aligning the rotating cylinder 120 of the interior handle set 100 with the first end 510 of the transmission element 500, it only requires to align the first end 510 of the transmission element 500 with the opening 121 and does not require to align the first end 510 of the transmission element 500 with the engaging groove 125. The transmission element 500 can be guided to enter the engaging groove 125 by the first curved surface 123*a* of the first guiding structure 123 and the first curved surface 124*a* of the second guiding structure 124. In the case that the rotating cylinder 120 only includes the first guiding structure 123 including the first curved surface 123*a* and the second curved surface 123*b*, when aligning the rotating cylinder 120 of the interior handle set 100 with the first end 510 of the transmission element 500, it only requires to align the first end 510 of the transmission element 500 with the opening 121 and does not require to align the first end 510 of the transmission element 500 with the engaging groove 125. The transmission element 500 can be guided to enter the engaging groove 125 by the first curved surface 123*a* or the second curved surface 123*b* of the first guiding structure 123.

Compared to the prior art, the lock according to present disclosure is disposed with the first guiding structure and/or the second guiding structure inside the rotating cylinder, when assembling the transmission element and the rotating cylinder, with the first curved surface of the first guiding structure and the first curved surface of the second guiding structure together guiding the transmission element, or with the first curved surface or the second curved surface of the first guiding structure/second guiding structure guiding the transmission element, the deviation angle between the transmission element and the rotating cylinder can be eliminated, such the transmission element can enter the engaging groove successfully. The user does not need to align the engaging groove of the rotating cylinder with the transmission element accurately, which can significantly reduce the assembling difficulty.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A rotating cylinder applied to a lock, the rotating cylinder being configured to guide a transmission element of the lock and defining a central axis, the rotating cylinder comprising:

an opening;

an inner wall communicated with the opening;

a first guiding structure formed on the inner wall, the first guiding structure comprising a first curved surface;

a second guiding structure formed on the inner wall and opposite to the first guiding structure, the second guiding structure comprising a first curved surface; and an engaging groove formed between the first guiding structure and the second guiding structure, the first curved surface of the first guiding structure and the first curved surface of the second guiding structure are closer to the opening than the engaging groove;

wherein when assembling the transmission element of the lock and the rotating cylinder, the first curved surface of the first guiding structure and the first curved surface of the second guiding structure guide the transmission element to enter the engaging groove.

2. The rotating cylinder of claim 1, wherein the transmission element comprises two corner portions opposite to each other, the first curved surface of the first guiding structure guides one of the corner portions, and the first curved surface of the second guiding structure guides the other one of the corner portions.

3. The rotating cylinder of claim 1, wherein the first curved surface of the first guiding structure and the first curved surface of the second guiding structure are symmetrical to each other about the central axis.

4. The rotating cylinder of claim 1, wherein when assembling the transmission element and the rotating cylinder, a deviation angle is between the transmission element and the rotating cylinder, the deviation angle is greater than 0 degree and less than 90 degrees.

5. The rotating cylinder of claim 1, wherein a distribution length of the first curved surface of the first guiding structure perpendicular to the central axis is L1, and a distribution length of the first curved surface of the first guiding structure parallel to the central axis is L2, the following condition is satisfied:

$$0.025<L1/L2<2.$$

6. The rotating cylinder of claim 1, wherein a distribution length of the first curved surface of the first guiding structure perpendicular to the central axis is L1, and a distribution length of the first curved surface of the first guiding structure parallel to the central axis is L2, the following condition is satisfied:

$$0.5<L1/L2<1.$$

7. The rotating cylinder of claim 1, wherein a distribution length of the first guiding structure perpendicular to the central axis is L3, and a width of the transmission element is L4, the following condition is satisfied:

$$1<L3/L4<1.2.$$

8. The rotating cylinder of claim 1, further comprising:

a narrow section communicated with the opening, wherein the first guiding structure is disposed on the narrow section, a minimum spaced distance between an end of the narrow section closer to the opening and the first guiding structure parallel to the central axis is L5, the following condition is satisfied:

$$0.5\text{ mm}<L5<10\text{ mm}.$$

9. The rotating cylinder of claim 1, further comprising:

a narrow section communicated with the opening, wherein the first guiding structure is disposed on the narrow section, a minimum spaced distance between an end of the narrow section closer to the opening and the first guiding structure parallel to the central axis is L5, the following condition is satisfied:

$$1\text{ mm}<L5<3\text{ mm}.$$

10. The rotating cylinder of claim 1, wherein the first guiding structure further comprises an abutting surface, the second guiding structure further comprises an abutting surface, the abutting surface of the first guiding structure and the abutting surface of first guiding structure define the engaging groove.

11. The rotating cylinder of claim 10, wherein when the transmission element and the rotating cylinder are in an assembled state, an abutting length between the transmission element and the abutting surface of the rotating cylinder parallel to the central axis is L6, the following condition is satisfied:

$$L6\geq 3\text{ mm}.$$

12. The rotating cylinder of claim 10, wherein the first guiding structure further comprises a dodging surface, the dodging surface is connected with the abutting surface of the first guiding structure, the dodging surface and the transmission element do not interfere with each other when assembling the transmission element and the rotating cylinder.

13. The rotating cylinder of claim 10, wherein the first guiding structure further comprises a second curved surface, a first dodging surface, a second dodging surface and a third dodging surface, the second curved surface and the first curved surface of the first guiding structure are extended in opposite directions, the first dodging surface is connected between the first curved surface and the abutting surface of the first guiding structure, the second dodging surface is connected between the second curved surface and the abutting surface of the first guiding structure, the third dodging surface is connected between the first curved surface, the second curved surface and the abutting surface of the first guiding structure, the first dodging surface, the second dodging surface, the third dodging surface and the transmission element do not interfere with each other when assembling the transmission element and the rotating cylinder.

14. The rotating cylinder of claim 1, wherein the first guiding structure further comprises a second curved surface, the second curved surface and the first curved surface of the first guiding structure are extended in opposite directions.

15. The rotating cylinder of claim 14, wherein the first curved surface and the second curved surface of the first guiding structure are mirror symmetric.

16. A lock, comprising:

an interior handle;

the rotating cylinder of claim 1, the rotating cylinder disposed in the interior handle in a relatively rotatable manner, an end of the rotating cylinder protruding from the interior handle;

a transmission element inserted in the engaging groove of the rotating cylinder; and a rotary button disposed on the end of the rotating cylinder;

wherein when the rotating cylinder is operated to rotate relative to the interior handle, the lock is capable of being switched between a locked state and an unlocked state.

17. The lock of claim 16, further comprising:

a lock member, wherein a first end of the transmission element is disposed in the rotating cylinder, a second end of the transmission element is engaged with the lock member, when the transmission element is brought to rotate by the rotating cylinder, the lock member is capable of being switched between a locked state and an unlocked state.

18. A rotating cylinder applied to a lock, the rotating cylinder being configured to guide a transmission element of the lock and defining a central axis, the rotating cylinder comprising:

an opening;

an inner wall communicated with the opening;

a first guiding structure formed on the inner wall, the first guiding structure comprising a first curved surface and a second curved surface, the first curved surface and the second curved surface are extended in opposite directions; and an engaging groove formed in the rotating cylinder, the first curved surface and the second curved surface of the first guiding structure are closer to the opening than the engaging groove;

wherein when assembling the transmission element of the lock and the rotating cylinder, the first curved surface or the second curved surface of the first guiding structure guides the transmission element to enter the engaging groove.

19. The rotating cylinder of claim 18, wherein when assembling the transmission element and the rotating cylinder, a deviation angle is between the transmission element and the rotating cylinder, the deviation angle is greater than 0 degree and less than 90 degrees.

20. The rotating cylinder of claim 18, wherein a distribution length of the first curved surface of the first guiding structure perpendicular to the central axis is L1, and a distribution length of the first curved surface of the first guiding structure parallel to the central axis is L2, the following condition is satisfied:

$$0.025<L1/L2<2.$$

21. The rotating cylinder of claim 18, wherein a distribution length of the first curved surface of the first guiding structure perpendicular to the central axis is L1, and a distribution length of the first curved surface of the first guiding structure parallel to the central axis is L2, the following condition is satisfied:

$$0.5<L1/L2<1.$$

22. The rotating cylinder of claim 18, wherein a distribution length of the first guiding structure perpendicular to the central axis is L3, and a width of the transmission element is L4, the following condition is satisfied:

$$1<L3/L4<1.2.$$

23. The rotating cylinder of claim 18, further comprising:

a narrow section communicated with the opening, wherein the first guiding structure is disposed on the narrow section, a minimum spaced distance between an end of the narrow section closer to the opening and the first guiding structure parallel to the central axis is L5, the following condition is satisfied:

$$0.5\text{ mm}<L5<10\text{ mm}.$$

24. The rotating cylinder of claim 18, further comprising:

a narrow section communicated with the opening, wherein the first guiding structure is disposed on the narrow section, a minimum spaced distance between an end of the narrow section closer to the opening and the first guiding structure parallel to the central axis is L5, the following condition is satisfied:

$$1\text{ mm}<L5<3\text{ mm}.$$

25. The rotating cylinder of claim 18, wherein the first guiding structure further comprises an abutting surface, the abutting surface of the first guiding structure corresponding to the engaging groove.

26. The rotating cylinder of claim 25, wherein when the transmission element and the rotating cylinder are in an assembled state, an abutting length between the transmission element and the abutting surface of the rotating cylinder parallel to the central axis is L6, the following condition is satisfied:

$$L6\geq 3\text{ mm}.$$

27. The rotating cylinder of claim 25, wherein the first guiding structure further comprises a dodging surface, the dodging surface is connected with the abutting surface of the first guiding structure, the dodging surface and the transmission element do not interfere with each other when assembling the transmission element and the rotating cylinder.

28. The rotating cylinder of claim 25, wherein the first guiding structure further comprises a first dodging surface, a second dodging surface and a third dodging surface, the first dodging surface is connected between the first curved surface and the abutting surface of the first guiding structure, the second dodging surface is connected between the second curved surface and the abutting surface of the first guiding structure, the third dodging surface is connected between the first curved surface, the second curved surface and the abutting surface of the first guiding structure, the first dodging surface, the second dodging surface, the third dodging surface and the transmission element do not interfere with each other when assembling the transmission element and the rotating cylinder.

* * * * *